US006755681B2

(12) United States Patent
Chen

(10) Patent No.: US 6,755,681 B2
(45) Date of Patent: Jun. 29, 2004

(54) CONNECTOR WITH SIGNAL DETECTION DEVICE

(75) Inventor: Chun-Chen Chen, Taoyuan Shien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 10/430,055

(22) Filed: May 5, 2003

(65) Prior Publication Data

US 2003/0211772 A1 Nov. 13, 2003

(30) Foreign Application Priority Data

May 13, 2002 (TW) ..... 091206770 A

(51) Int. Cl.[7] ..... H01R 3/00
(52) U.S. Cl. ..... 439/489; 439/675
(58) Field of Search ..... 439/489, 675, 439/676, 931, 188, 488

(56) References Cited

U.S. PATENT DOCUMENTS 5,904,578 A * 5/1999 Kubota et al. ..... 439/63
6,149,464 A * 11/2000 DeBauche et al. ..... 439/609
6,461,199 B1 * 10/2002 Koga et al. ..... 439/668
2004/0002266 A1 * 1/2004 Hinkle et al. ..... 439/675

* cited by examiner

*Primary Examiner*—Hien Vu
(74) *Attorney, Agent, or Firm*—Volpe and Koenig, P.C.

(57) ABSTRACT

A connector with a signal detection device for plugging in a corresponding socket of an electronic device is provided, wherein the socket includes a central protruding conductor and an outer insulating portion and the outer insulating portion includes a first contacting flexible piece and a second contacting flexible piece. The connecter includes a first conducting portion for contacting with the central protruding conductor, a second conducting portion for contacting with the first contacting flexible piece of the outer insulating portion, and a third conducting portion for contacting with the second contacting flexible piece, wherein when the connector is plugged in the socket of the electronic device so as to contact the third conducting portion with the second contacting flexible piece, the third conducting portion outputs a detecting signal for being recognized, and the connector stands on the detecting signal to decide whether power is outputted to the electronic device or not.

14 Claims, 4 Drawing Sheets

CONNECTOR WITH SIGNAL DETECTION DEVICE

FIELD OF THE INVENTION

This invention relates to a connector with a signal detection device, and more particular to a connector with a signal detection device which automatically recognizes whether the electricity can be conducted or not corresponding to different powers of different electronic devices and can be applied in a conventional connector.

BACKGROUND OF THE INVENTION

Presently, a connector 1 (so called a plug) of a general power converter usually has a tuber structure, whose cross-sectional structure is shown in FIG. 1, and includes a first conducting portion 11, an insulating portion 12 and a second conducting portion 13, wherein the connector 1 further includes a power circuit (not shown) which is electrically connected to the first conducting portion 11 and the second conducting portion 13 for providing power. The insulating portion 12 is located between the first conducting portion 11 and the second conducting portion 13 for providing a function of insulation so as to isolate the two conducting portions (11 and 13). A conventional socket 2, whose cross-sectional structure is also shown in FIG. 1, also has a tuber structure corresponding to the connector 1. The socket 2 includes a central protruding conductor 21 and an external insulating portion 22 which further includes a contacting flexible piece 221. When the connector 1 is plugged in the socket 2, the central protruding conductor 21 will contact with the first conducting portion 11 and the contacting flexible piece 221 of the external insulating portion 22 will contact with the second conducting portion 13. Under this condition, because the central protruding conductor 21 and the first conducting portion 11 are both positive electrode terminals and the contacting flexible piece 221 and the second conducting portion 13 are both negative electrode terminals, as labeled in FIG. 1, the connector 1 and the socket 2 can be conducted. Therefore, a power can be outputted to the socket 2 and the electronic device (not shown), where the socket 2 is set thereon, by the power circuit which is connected to the first and the second conducting portions 11 and 13.

However, the electronic devices in the market always have different power demands. Thus, the electronic devices with different power demands have to employ different power converters which are corresponding to the different power demands. Generally, a power converter having a smaller power will be insufficient for an electronic device which needs a larger power, but a power converter with a larger power oppositely is suitable for an electronic device which needs a smaller power. But, no matter which kind of electronic device and power converter, the socket and the connector employed are both designed in a communal standard and can not be differentiated from the appearance thereof. Thus, when operating, it will be easy to plug a wrong connector with a smaller power into a socket which needs a larger power and then cause the situations as follows:

1. The electronic device will be unceasingly on and off: the smaller power provided by the power converter is exactly sufficient to initiate the electronic device which needs a larger power but is insufficient to maintain a continuous operation of the electronic device, and thus the electronic device will be disconnected. However, because the continuously outputted power from the power converter, the electronic device will be initiated again and further because of the reason described above, the power will be interrupted again. As a result of the continuous initiation and interruption, for the electronic device, the electronic elements inside will always suffer a high-voltage initiating power and will be damaged easily. Furthermore, because the power converter has to provide the power unceasingly, it will be over-heated easily so as to reduce the life thereof.

2. The electronic device will be on and shut down: although the power transformer with the smaller power can initiate the electronic device which needs the larger power, the operating efficiency of the electronic device is still not good because of the insufficient power supply and a highly possibility of disconnection. Furthermore, if the electronic device is disconnected during a process of data transmission without warning, the data might be lost or damaged.

Because of the technical defects described above, the applicant keeps on carving unflaggingly to develop a "connector with signal detection device" through wholehearted experience and research.

SUMMARY OF THE INVENTION

It is an object of the present invention to provide a connector with a signal detection device which provides a signal detecting mechanism under the conventional standard.

It is another object of the present invention to provide a connector with a signal detection device which can determine an electrical conduction state of an electronic device through a recognizing portion provided by a corresponding socket of the electronic device.

It is a further object of the present invention to provide a connector with a signal detection device which has an automatic recognizing function in response to the different powers of the electronic devices so as to control an electrical conduction of the electronic device.

In accordance with an aspect of the present invention, a connector with a signal detection device for plugging in a corresponding socket of an electronic device, wherein the socket includes a central protruding conductor and an outer insulating portion and the outer insulating portion includes a first contacting flexible piece and a second contacting flexible piece. The connecter includes a first conducting portion for contacting with the central protruding conductor, a second conducting portion for contacting with the first contacting flexible piece of the outer insulating portion, and a third conducting portion for contacting with the second contacting flexible piece, wherein when the connector is plugged in the socket of the electronic device so as to contact the third conducting portion with the second contacting flexible piece, the third conducting portion outputs a detecting signal for being recognized, and the connector stands on the detecting signal to decide whether power is outputted to the electronic device or not.

Preferably, the connector further includes a first insulating portion located between the first conducting portion and the second conducting portion.

Preferably, the connector further includes a second insulating portion located between the second conducting portion and the third conducting portion.

Preferably, the connector further includes a power circuit for connecting to the first conducting portion and the second conducting portion and providing the power.

Preferably, the detecting signal is an output current/voltage.

Preferably, the detecting signal is provided by an impedance which is electrically connected to the power circuit so as to electrically connect to the third conducting portion.

Preferably, the impedance is electrically connected to one of an anode and a cathode of the power circuit.

Preferably, the impedance is one selected from a group consisting of a resistor, an inductor, a capacitor, and a combination thereof.

Preferably, the second contacting flexible piece is a recognizing portion and is further electrically connected to a detecting circuit of the electronic device for determining an electrical conduction state of the electronic device through the detecting signal.

Preferably, the electrical conduction state of the electronic device is determined via a comparison between the output current/voltage and a reference current/voltage of the detecting circuit, and when the output current/voltage is relatively larger than or equal to the reference current voltage, the detecting circuit will be conducted, and when the output current voltage is relatively smaller than the reference current/voltage, the detecting circuit will not be conducted.

Preferably, the detecting circuit is a close loop circuit so as to determine one condition of maintaining the electrical conduction state and a disconnecting the close loop circuit corresponding to the detecting signal.

Preferably, the first contacting flexible piece is located at an area which is relatively closer to an opening of the socket with respect to the recognizing portion for electrically connecting to and engaged with the second conducting portion.

Preferably, the detecting circuit is an open loop circuit so as to determine one condition of maintaining a disconnection state and conducting the open loop circuit corresponding to the detecting signal.

Preferably, the electronic device is one of a portable electronic equipment and a non-portable electronic equipment.

Preferably, the electronic equipment is one selected from a group consisting of a notebook, a mobile phone, a personal digital assistant (PDA), a pocket PC, a digital camera, a scanner, a printer and a LCD monitor.

In accordance with another aspect of the present invention, a connecting combination for providing a detecting signal to an electronic device, includes a socket positioned in the electronic device and comprising a central protruding conductor and an outer insulating portion, wherein the outer insulating portion includes a first contacting flexible piece and a second contacting flexible piece, a connector plugged in the socket and comprising a first conducting portion for contacting with the central protruding conductor, a second conducting portion for contacting with the first contacting portion, and a third conducting portion for contacting with the second contacting portion, wherein the third conducting portion outputs a detecting signal for being recognized when the connector is plugged in the socket of the electronic device and the third conducting portion is contacted with the second contacting flexible piece, and the connector stands on the detecting signal to decide whether a power is outputted to the electronic device or not.

In accordance with a further aspect of the present invention, a connector with a signal detection device for plugging in a corresponding socket of an electronic device, wherein the socket includes a central protruding conductor and an outer insulating portion, and the outer insulating portion includes a first contacting flexible piece and a second contacting flexible piece, includes a first conducting portion for contacting with the central protruding conductor, a second conducting portion for contacting with the first contacting flexible piece, and a third conducting portion for contacting with the second contacting flexible piece, wherein when the connector is plugged in the socket of the electronic device, one selected from a group consisting of the first conducting portion, the second conducting portion and the third conducting portion outputs a detecting signal for being recognized, and the connector stands on the detecting signal to decide whether a power is outputted to the electronic device or not.

Preferably, the detecting signal is outputted by the first conducting portion and the central protruding conductor is a recognizing portion, so that when the connector is plugged in the socket, the connector stands on the detecting signal and the recognizing portion to decide whether the power is outputted to the electronic device or not.

Preferably, the connector 18 further includes a power circuit connecting to the second conducting portion and the third conducting portion for providing the power.

Preferably, the detecting signal is outputted by the second conducting portion and the first contacting flexible piece is a recognizing portion, so that when the connector is plugged in the socket, the connector stands on the detecting signal and the recognizing portion to decide whether the power is outputted to the electronic device or not.

Preferably, the connector further includes a power circuit connecting to the first conducting portion and the third conducting portion for providing the power.

Preferably, the detecting signal is outputted by the third conducting portion and the second contacting flexible piece is a recognizing portion, so that when the connector is plugged in the socket, the connector stands on the detecting signal and the recognizing portion to decide whether the power is outputted to the electronic device or not.

Preferably, the connector further includes a power circuit connecting to the first conducting portion and the second conducting portion for providing the power.

Preferably, the recognizing portion is further connected to a detecting circuit of the electronic device for recognizing the detecting signal so as to control the electrical conduction of the electronic device.

In accordance with a further another aspect of the present invention, a connector with a signal detection device for plugging in a corresponding socket of an electronic device, wherein the socket includes a recognizing portion and the connector includes a first conducting portion, a second conducting portion and a third conducting portion, characterized in that when the connector is plugged in the socket of the electronic device, one selected from a group consisting of the first conducting portion, the second conducting portion and the third conducting portion outputs the detecting signal for being recognized, and the connector stands on the detecting signal to decide whether power is outputted to the electronic device or not.

In accordance with a further another aspect of the present invention, a connector with a signal detection device for plugging in a corresponding socket of an electronic device, wherein the socket includes plural contacting conducting portions. The connecter includes plural conducting portions having a corresponding relationship with the plural contacting conducting portions of the socket, wherein the plural conducting portions includes a first number of conducting portion and a second number of conducting portion, when the connector is plugged in the socket of the electronic device, the first number of conducting portion outputs a first number of detecting signal and contacts with a first number of contacting conductor, and the connector stands on the detecting signal to decide whether power is outputted to the electronic device or not.

Preferably, each of the plural conducting portions has an insulating portion.

Preferably, the corresponding relationship is a one-on-one relationship.

Preferably, the first number of contacting conductor is a first number of recognizing portion, and when the connector is plugged in the socket, the connector stands on the first number of detecting signal and the first number of recognizing portion to decide whether the power is outputted to the electronic device or not for completing the electrical conduction.

Preferably, the first number of conducting portion is at least a conducting portion.

Preferably, the second number of conducting portion is at least two conducting portions and is connected to at least a power circuit for providing the power.

In accordance with an additional aspect of the present invention, a connector with a signal detection device for plugging in a corresponding socket of an electronic device, wherein the connector includes plural conducting portions and the socket includes a recognizing portion, characterized in that when the connector is connected to the socket and one of plural conducting portions is contacted with the recognizing portion, one of plural conducting portion outputs a detecting signal and, the connector stands on the detecting signal to decide whether a power is outputted to the electronic device or not for completing an electrical conduction.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

Figure 1:
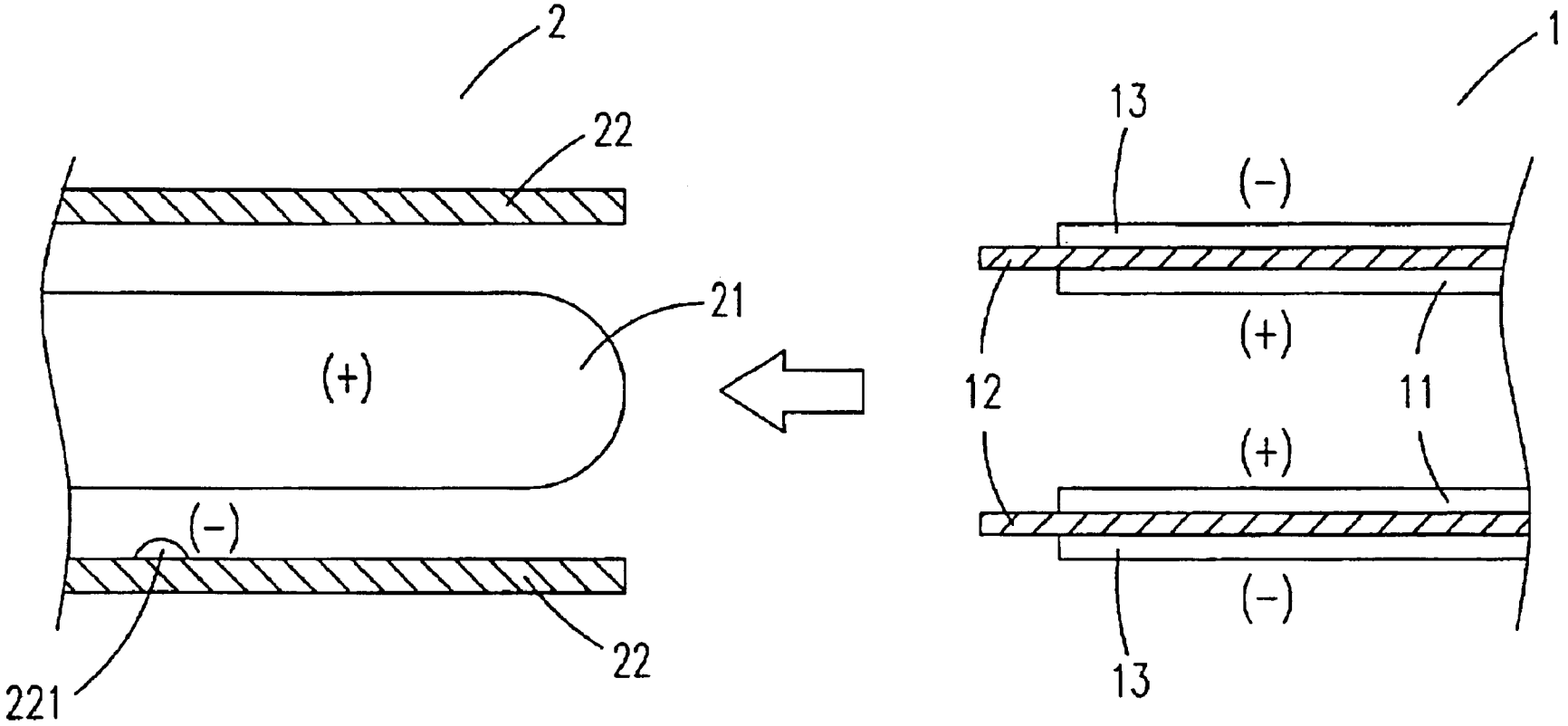
Fig. 1 (PRIOR ART)
FIG. 1 shows a cross-section view of the structure of a connector and a corresponding socket in the prior arts.
Figure 2:
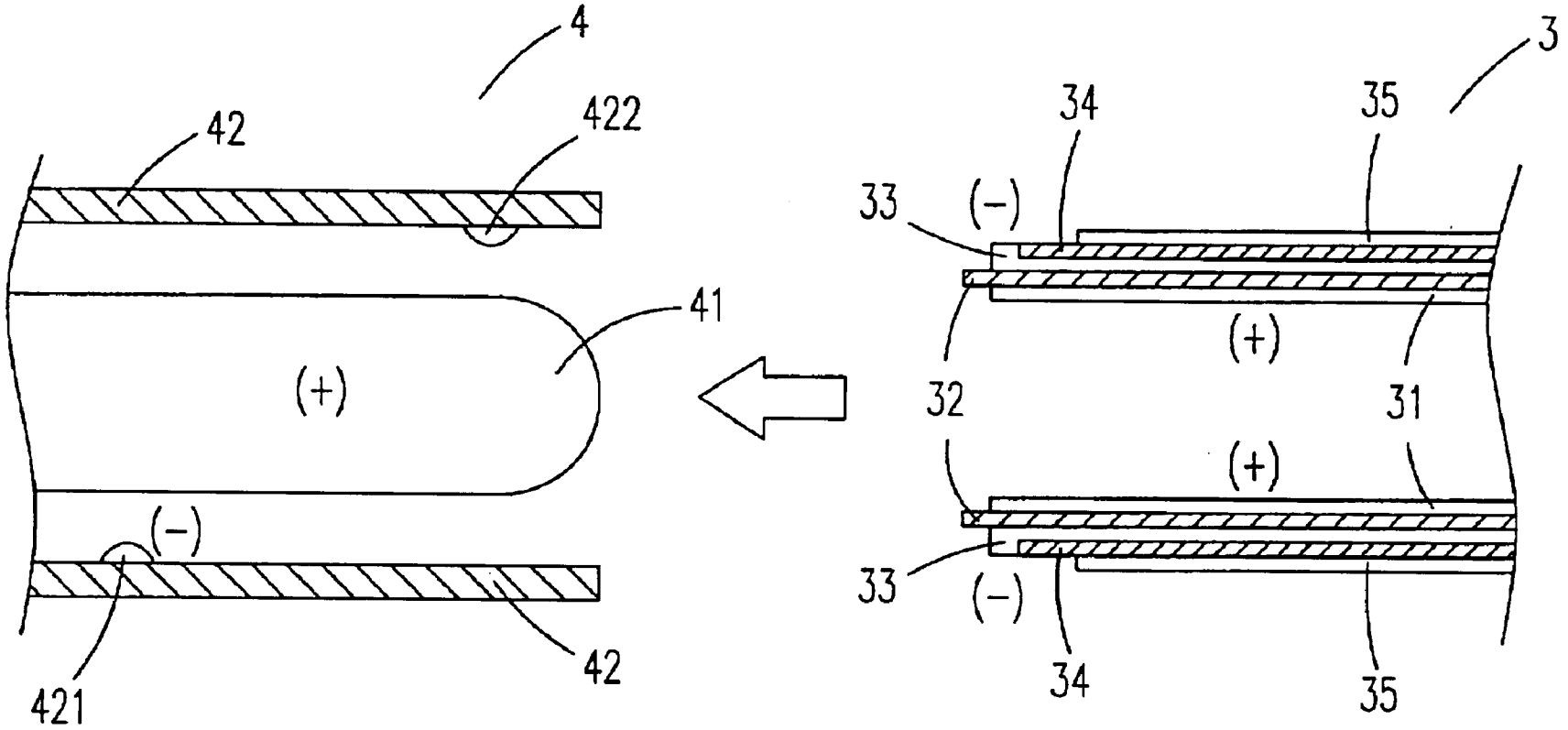
FIG. 2 shows a cross-section view of the structure of a connector with a signal detection device and a corresponding socket in a first embodiment according to the present invention.
Figure 3:
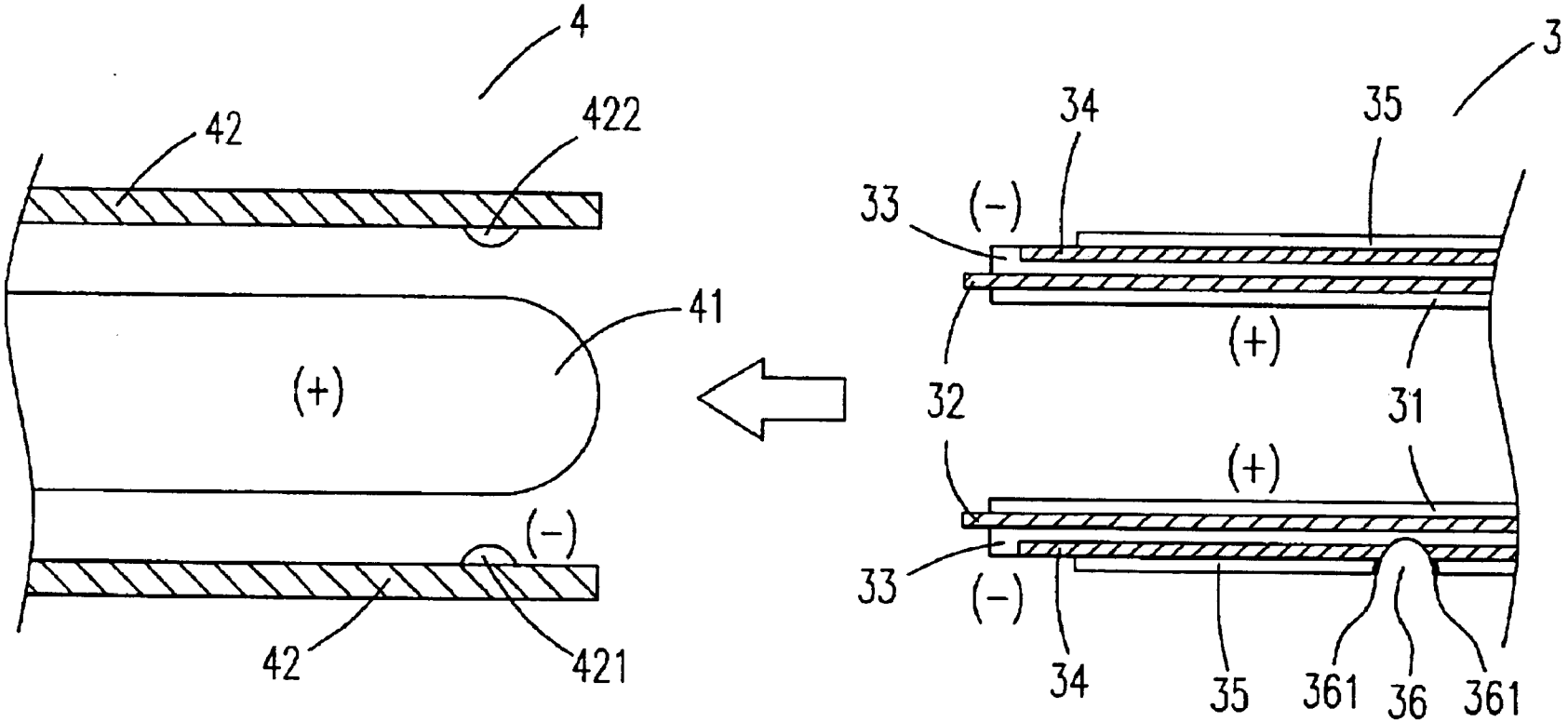
FIG. 3 shows a cross-section view of the structure of a connector with a signal detection device and a corresponding socket in a second embodiment according to the present invention.

Please refer to FIGS. 2 and 3 which illustrate cross-section views of the structure of a connector with a signal detection device and a corresponding socket in a first and a second embodiments according to the present invention. As shown in FIGS. 2 and 3, a connector 3, which has an identical tubular standard structure with the conventional connector 1 (as shown in FIG. 1), but not be limited, includes a first conducting portion 31, a first insulating portion 32, a second conducting portion 33, a second insulating portion 34 and a third conducting portion 35, wherein the connector 3 further includes a power circuit (not shown) which is connected to the first conducting portion 31 and the second conducting portion 33 for providing a power, the first insulating portion 32 is positioned between the first conducting portion 31 and the second conducting portion 33 for providing an insulating effect therebetween, and the second insulating portion 34 is positioned between the second conducting portion 33 and the third conducting portion 35 for also providing an insulating effect therebetween.

Further referring to FIGS. 2 and 3, a socket 4, which has an identical tubular standard structure with the conventional socket 2 (as shown in FIG. 1), but not be limited, corresponding to the connector 3 includes a central protruding conductor 41 and an outer insulating portion 42, wherein the outer insulating portion 42 further includes a first contacting flexible piece 421 and a second contacting flexible piece 422. Therefore, when the connector 3 is plugged in the corresponding socket 4, the central protruding conductor 41 will contact with the first conducting portion 31, the first contacting flexible piece 421 of the outer insulating portion 42 will contact with the second conducting portion 33, and the third conducting portion 35 will contact with the second contacting flexible piece 422. Furthermore, as shown in FIGS. 2 and 3, the central protruding conductor 41 and the first conducting portion 31 have a positive polarity and the first contacting flexible piece 421 and the second conducting portion 33 have a negative polarity, namely the portions which are contacted to each other have an identical polarity, so that the connector 3 and the socket 4 can be electrically conducted. However, the central protruding conductor 31 is not limited to have a positive polarity and the first contacting flexible piece 421 is also not limited to have a negative polarity. There is only one point that the connector 3 and the socket 4 must have differently polarities and the contact portions must have identical polarity, namely, the connector and the socket can be conducted.

The characteristic of the present invention is that a detecting signal (not shown) can be outputted by the third conducting portion 35. When the connector 3 is plugged in the socket of an electronic device (not shown), the third conducting portion 35 will contact with the second contacting flexible piece 422 and, through recognizing the detecting signal by the second contacting flexible piece 422 (so called a recognizing portion), the power circuit which is connected to the first conducting portion 31 and the second conducting portion 33 can successfully output the power to the socket 4 for electrically conducting the electronic device. And, the difference between FIG. 2 and FIG. 3 is the different position of the first contacting flexible piece.

Preferably, the electronic device can be a portable electronic equipment or a non-portable electronic equipment, e.g., a notebook, a mobile phone, a personal digital assistant (PDA), a pocket PC, a digital camera, a scanner, a printer and a LCD monitor. Otherwise, the shape of the first contacting flexible piece 421 of the outer insulating portion 42 can be changed, so that, except contacting with the second conducting portion 33, the first contacting flexible piece can further own a fixing function (not shown).

Figure 4:
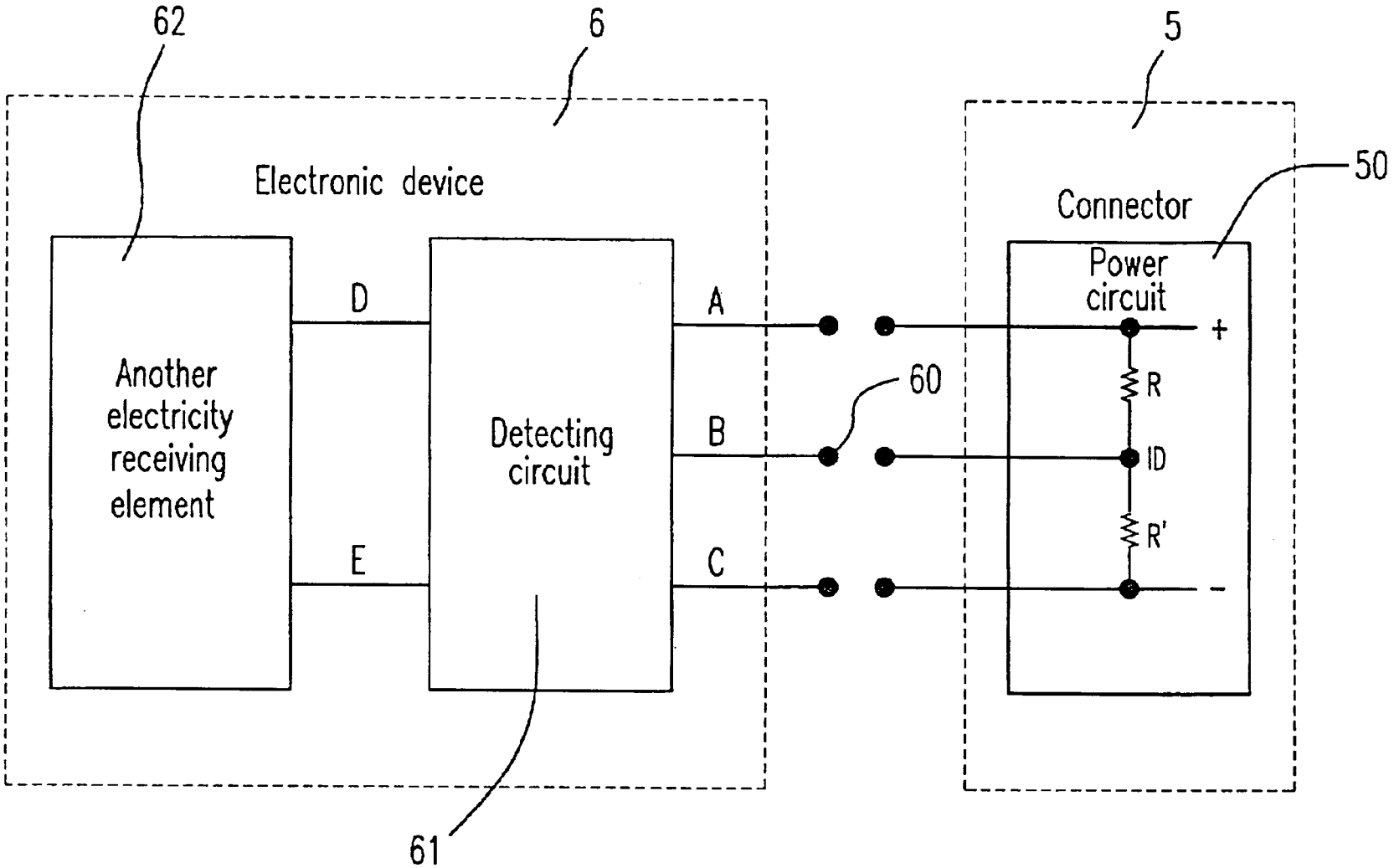
FIG. 4 shows a schematic view of a recognizing method and a corresponding circuit of a connector with a signal detection device and an electronic device in a preferred embodiment according to the present invention.

Please refer to FIG. 4 which illustrates a schematic view of a recognizing method and a corresponding circuit of a connector with a signal detection device and an electronic device in a preferred embodiment according to the present invention. The detecting signal ID provided by the connector 5 is an output current/voltage (please refer to FIG. 2, which is outputted by the third conducting portion 35). A recognizing portion 60 set on the socket (not shown) of an electronic device 6 is electrically connected to a detecting circuit 61 inside the electronic device 6 and, through the detecting circuit 61, the detecting signal ID can be recognized so as to further control an electrical conduction of another electricity receiving element 62 and also decide the initiation of the electronic device 6.

The principle is to decide the conduction of the detecting circuit 61 through a comparison between the output current/voltage (namely the detecting signal ID in FIG. 4) and a reference current/voltage level (not shown). When the output current/voltage is larger than or equal to the reference current/voltage, the detecting circuit 61 can be conducted, so that another electricity receiving element 62 of the detecting circuit 61 can be initiated for successfully receiving the power outputted by the power circuit 50 and electrically conducting the electronic device 6. And, the detecting circuit 61 will be disconnected when the output current/voltage is smaller than the reference current/voltage, so that another electricity receiving element 62 will not be initiated and the electronic device will not be electrically conducted, either.

Through employing an impedance (R or R') to electrically connect to the power circuit 50 of the connector 5 so as to further connect to the third conducting portion 35 (please refer to FIG. 2), the detecting signal ID can be outputted by the third conducting portion 35. As to the impedance (R or R'), it is not limited to connect to the positive electrode or the negative electrode of the power circuit 50 and can be a resistor, an inductor, a capacitor or a combination thereof.

The embodiment of the recognizing method described above can be explained through a line (R) and a dotted line (R') of the power circuit 50 in FIG. 4. The resistor symbol R or R' represents the impedance described above. If the detecting signal ID is connected to the positive electrode of the power circuit 50 so as to further connect to a resistor R (namely the line portion) and causes a disconnection to the negative electrode of the power circuit 50, when the connector is plugged into the electronic device 6, the detecting signal ID will be connected with the recognizing portion 60 and be transmitted to the detecting circuit 61 for being compared. If it is electrically conducted, namely the detecting signal ID is larger than or equal to the reference current/voltage level in the detecting circuit 61, the line C–E will be conducted and the line B–C will be disconnected. Therefore, another electricity receiving element 62 can be conducted for successfully receiving the power outputted by the power circuit 50 to conduct the electronic device 6. If it is a disconnecting state, namely the outputting current/voltage is smaller than the reference current/voltage level, the line C–E will be disconnected so that another electricity receiving element 62 cannot be initiated. Oppositely, if the detecting signal ID is connected to the negative electrode of the power circuit 50 so as to further connect to a resistor R' (namely the dotted line portion) and causes a disconnection to the positive electrode of the power circuit 50, when the detecting signal ID is larger than or equal to the reference current/voltage level in the detecting circuit 61, namely the line A–D is conducted and the line B–C is disconnected, another electricity receiving element 62 and the detecting circuit 61 will be conducted. When the outputting current/voltage is smaller than the reference current/voltage level, the line A–D will be disconnected so that another electricity receiving element 62 and the detecting circuit 62 will be disconnected, too.

Please again refer to FIGS. 2~4. The position of the first contacting flexible piece 421 can be changed for cooperating with the detecting circuit 61. If the detecting circuit 61 is a close loop circuit, namely the detecting circuit is conducted all the time, it will be unceasingly conducted or disconnect the close loop circuit. Under this condition, the position of the contacting flexible piece 421 has to be located more inner than the position of the second contacting flexible piece 422 in the socket 4 (as shown in FIG. 2). Therefore, the second conducting portion 33 will not contact with the contacting flexible piece 421 before the third conducting portion contacts with the recognizing portion 422. Because the third conducting portion 35 has to output the detecting signal for recognizing previously, the conduction between the second conducting portion 33 and the contacting flexible piece 421 has to be happened thereafter. Oppositely, if the detecting circuit 61 is an open loop circuit, namely the detecting circuit is disconnected all the time, it will be unceasingly disconnected or conduct the open loop circuit. Under this condition, the position of the contacting flexible piece 421 will not be limited. It can be located at the position described above (as shown in FIG. 2) or located at a position identical to the recognizing portion 422 (as shown in FIG. 3). However, if the first contacting flexible piece 421 and the recognizing portion 422 are located at a same position, a concave 36 has to be formed inside the connector 3 for electrically connecting with the second conducting portion 33. Furthermore, the concave 36 and the first contacting flexible piece 421 can have a lock-in function through the shape thereof. But, a portion of the concave 36 which exposes the third conducting portion 35 must be covered by an insulating layer so that the second conducting portion 33 and the third conducting portion 35 can be insulated to avoid a short circuit. Because this process will increase the trouble of fabricating and also the cost, it is common to set the first contacting flexible piece at a position more inner than the recognizing portion 422 in the socket.

Moreover, the recognizing portion 60 of the electronic device 6 can be designed on the original printed circuit board (PCB) without altering the PCB module. Therefore, it only needs to alter the setting of the detecting signal ID and further design the corresponding socket having the recognizing portion and the detecting circuit therein. The present invention can be applied in any kind of connector and socket.

The embodiments described above all focus that the detecting signal ID is outputted by the third conducting portion. However, the connector according to the present invention is not limited to output the detecting signal ID only through the third conducting portion 35. The detecting signal of the connector according to the present invention can be outputted through any one of the first conducting portion 31, the second conducting portion 33 or the third conducting portion 35. When the detecting signal ID is outputted by the first conducting portion 31, the central protruding conductor 41 will be the recognizing portion. Thus, when the connector 3 is plugged into the corresponding socket 4, the connector 3 can output a power to the electronic device through recognition of the detecting signal ID and the recognizing portion 41 for conducting the electronic device. And, the power provided by the connector 3 will be supplied by the power circuit 50 which is connected to the second conducting portion 33 and the third conducting portion 35. Moreover, when the detecting signal ID is outputted by the second conducting portion 33, the first flexible piece 421 will be the recognizing portion. Thus, when the connector 3 is plugged into the corresponding socket 4, the connector 3 can output a power to the electronic device through recognition of the detecting signal ID and the recognizing portion 421 for conducting the electronic device. And, the power provided by the connector 3 will be supplied by the power circuit 50 which is connected to the first conducting portion 31 and the third conducting portion 35. Furthermore, when the detecting signal ID is outputted by the third conducting portion 35, the second flexible piece 422 will be the recognizing portion (which is the preferred embodiment described in FIGS. 2 and 3). Thus, when the connector 3 is plugged into the corresponding socket 4, the connector 3 can output a power to the electronic device through recognition of the detecting signal ID and the recognizing portion 422 for conducting the electronic device. And, the power provided by the connector 3 will be supplied by the power circuit 50 which is connected to the first conducting portion 31 and the second conducting portion 33. Just like shown in FIG. 4, the recognizing portion (41, 421 or 422) will be further connected to a detecting circuit 61 of the electronic device 6, and, through recognizing the signal, the electronic device 6 can be controllably conducted.

Furthermore, the connector according to the present invention will not be limited to have only three conducting layers but can provide more conducting portions (not shown) which have a corresponding number to that of the contacting conductors in the socket. Generally, it is a one-on-one condition. If the conducting portions are constructed by a first number and a second number of conducting portion, the first number of conducting portion will provide a first number of detecting signals, however, generally one detecting signal, but not limited. When the connector is plugged in the socket of the electronic device, the conducting portions which provide the detecting signals will respectively connect with the corresponding contacting conductors, and, through recognizing the detecting signal, the connector will output the power to conduct the electronic device. Furthermore, the second number of conducting portion provides power sources which are provided by the power circuits connected to the second number of conducting portion. The second number of conducting portion is generally at least two conducting portions for providing at least a power source. If the second number is three, it can have two positive terminals and one communal negative terminal to provide two power sources. If the second number is four, it can have respectively two positive and two negative terminals to provide two power sources.

In view of the aforesaid, the present invention provides a novel mechanism design of a connector structure which can be applied in the prior arts without changing the standards thereof. Therefore, through a simple circuit, the connector can provide a detecting signal to a recognizing portion of a corresponding socket so as to, for example, automatically recognize the different powers of different electronic devices for further controlling the conduction between the connector and the electronic device. Thus, a damage caused by plugging a wrong connector into a socket can be avoided. Moreover, the detecting signal can be set to be outputted by different conducting portions in response to different demands. Furthermore, because it can be applied in the conventional connector and socket, the manufacturing cost will not be increased though the improvement provided by the present invention. Consequently, the present invention overcomes the defects in the prior arts to satisfy the convenience and expansion under using and is valuable for the industrial development.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector with a signal detection device for plugging in a corresponding socket of an electronic device, wherein said socket comprises a central protruding conductor and an outer insulating portion and said outer insulating portion comprises a first contacting flexible piece and a second contacting flexible piece, a tubular structure said connecter comprising:

a first conducting portion for contacting with said central protruding conductor;

a second conducting portion for contacting with said first contacting flexible piece of said outer insulating portion; and a third conducting portion for contacting with said second contacting flexible piece, wherein when said connector is plugged in said socket of said electronic device so as to contact said third conducting portion with said second contacting flexible piece, said third conducting portion outputs a detecting signal for being recognized, and said connector stands on said detecting signal to decide whether power is outputted to said electronic device or not wherein said connector further comprises a first insulating portion located between said first conducting portion and said second conducting portion and said connector further comprises a second insulating portion located between said second conducting portion and said third conducting portion.

2. The connector according to claim 1 further comprising a power circuit for connecting to said first conducting portion and said second conducting portion and providing said power.

3. The connector according to claim 2, wherein said detecting signal is an output current/voltage and is provided by an impedance which is electrically connected to said power circuit so as to electrically connect to said third conducting portion.

4. The connector according to claim 3, wherein said impedance is electrically connected to one of an anode and a cathode of said power circuit and is one selected from a group consisting of a resistor, an inductor, a capacitor, and a combination thereof.

5. The connector according to claim 3, wherein said second contacting flexible piece is a recognizing portion and is further electrically connected to a detecting circuit of said electronic device for determining an electrical conduction state of said electronic device through said detecting signal.

6. The connector according to claim 5, wherein said electrical conduction state of said electronic device is determined via a comparison between said output current/voltage and a reference current/voltage of said detecting circuit, and when said output current/voltage is relatively larger than or equal to said reference current/voltage, said detecting circuit will be conducted, and when said output current/voltage is relatively smaller than said reference current/voltage, said detecting circuit will not be conducted.

7. The connector according to claim 5, wherein said detecting circuit is a close loop circuit so as to determine one condition of maintaining said electrical conduction state and a disconnecting said close loop circuit corresponding to said detecting signal or an open loop circuit so as to determine one condition of maintaining a disconnection state and conducting said open loop circuit corresponding to said detecting signal.

8. The connector according to claim 7, wherein said first contacting flexible piece is located at an area which is relatively closer to an opening of said socket with respect to said recognizing portion for electrically connecting to and engaged with said second conducting portion.

9. The connector according to claim 1, wherein said electronic device is one of a portable electronic equipment and a non-portable electronic equipment and said electronic equipment is one selected from a group consisting of a notebook, a mobile phone, a personal digital assistant (PDA), a pocket PC, a digital camera, a scanner, a printer and a LCD monitor.

10. A connecting combination for providing a detecting signal to an electronic device comprising:

a socket positioned in said electronic device and comprising a central protruding conductor and an outer insulating portion, wherein said outer insulating portion comprises a first contacting flexible piece and a second contacting flexible piece;

a connector plugged in said socket comprising a tubular structure having first conducting portion for contacting with said central protruding conductor, a second conducting portion for contacting with said first contacting portion, and a third conducting portion for contacting with said second contacting portion, wherein said third conducting portion outputs a detecting signal for being recognized when said connector is plugged in said socket of said electronic device and said third conducting portion is contacted with said second contacting flexible piece, and said connector stands on said detecting signal to decide whether power is outputted to said electronic device or not wherein said connector further comprises a first insulating portion located between said first conducting portion and said second conducting portion and said connector further comprises a second insulating portion located between said second conducting portion and said third conducting portion.

11. A connector with a signal detection device for plugging in a corresponding socket of an electronic device, wherein said socket comprises a central protruding conductor and an outer insulating portion, and said outer insulating portion comprises a first contacting flexible piece and a second contacting flexible piece, a tubular structure said connecter comprising:

a first conducting portion for contacting with said central protruding conductor;

a second conducting portion for contacting with said first contacting flexible piece; and a third conducting portion for contacting with said second contacting flexible piece, wherein when said connector is plugged in said socket of said electronic device, one selected from a group consisting of said first conducting portion, said second conducting portion and said third conducting portion outputs a detecting signal for being recognized, and said connector stands on said detecting signal to decide whether power is outputted to said electronic device or not wherein said connector further comprises a first insulating portion located between said first conducting portion and said second conducting portion and said connector further comprises a second insulating portion located between said second conducting portion and said third conducting portion.

12. The connector according to claim 11, wherein said detecting signal is outputted by said first conducting portion and said central protruding conductor is a recognizing portion, so that when said connector is plugged in said socket, said connector stands on said detecting signal and said recognizing portion to decide whether said power is outputted to said electronic device or not.

13. The connector according to claim 11, wherein said detecting signal is outputted by said second conducting portion and said first contacting flexible piece is a recognizing portion, so that when said connector is plugged in said socket, said connector stands on said detecting signal and said recognizing portion to decide whether said power is outputted to said electronic device or not.

14. The connector according to claim 11, wherein said detecting signal is outputted by said third conducting portion and said second contacting flexible piece is a recognizing portion, so that when said connector is plugged in said socket, said connector stands on said detecting signal and said recognizing portion to decide whether said power is outputted to said electronic device or not.

* * * * *